United States Patent [19]

Ichimura

[11] Patent Number: 4,669,402

[45] Date of Patent: Jun. 2, 1987

[54] DEVICE FOR RETAINING A TAILORING FABRIC IN A BLIND STITCH OPERATION

[75] Inventor: Masatoshi Ichimura, Higashiosaka, Japan

[73] Assignee: Satoh Seiki Co., Ltd., Japan

[21] Appl. No.: 834,550

[22] Filed: Feb. 28, 1986

[30] Foreign Application Priority Data

Mar. 25, 1985 [JP] Japan ..... 60-60215

[51] Int. Cl.[4] ..... D05B 1/24

[52] U.S. Cl. ..... 112/178

[58] Field of Search ..... 112/175, 176, 177, 178

[56] References Cited

U.S. PATENT DOCUMENTS

| | | | |
|---|---|---|---|
| 284,300 | 9/1883 | Heberling | 112/175 |
| 1,645,257 | 10/1927 | Rossmann | 112/175 |
| 2,876,722 | 3/1959 | Parry . | |
| 3,572,269 | 3/1971 | Fletcher et al. | 112/178 |
| 4,312,290 | 1/1982 | Norz | 112/178 |

FOREIGN PATENT DOCUMENTS

| | | |
|---|---|---|
| 2552456 | 9/1984 | France . |

*Primary Examiner*—H. Hampton Hunter

*Attorney, Agent, or Firm*—Larson and Taylor

[57] ABSTRACT

The invention relates to a device for adjusting position of a holding plate on which a tailoring fabric is nipped with a presser rod. Pick-up sewing is conducted by the inventive device commensurate with change of fabric thickness during sewing route.

2 Claims, 2 Drawing Figures

DEVICE FOR RETAINING A TAILORING FABRIC IN A BLIND STITCH OPERATION

FIELD OF THE INVENTION

This invention relates to a device for retaining a fabric in a blind stitch operation performed in an automatic sewing machine. More particularly, this invention relates to a device for adjusting the position of a fabric holding plate on which the subject fabric is held and sewn.

BACKGROUND OF THE INVENTION

Blind stitch sewing is a method in which yarn or thread is sewn so as to emerge as a seam only on one side of the fabric while either submerging or not appearing at all on the other side. This type of sewing method is generally applied, for example, to fit a patched pocket or an outer pocket on a suit fabric since pocket formation may desirably be finished without emergence of a seam on the front the suit.

Conventionally, the blind stitch operation has been performed by effecting sewing motions of a curved needle reciprocatingly piercing the fabric along a slant or lateral direction instead of perpendicular thereto. According to this procedure, the inner pressure in the fabric must be carefully adjusted so as not to change position or be accelerated during the sewing motions. Although changes or sharp accelerations of fabric pressure should be avoided in blind stitch sewing, this is difficult due to the thickness of the fabric to be sewn. Examples of such blind stitch sewing include forming a patch pocket or a dart in a jacket suit. These operations do incur the difficulties noted above.

The need to adjust the fabric may be accomplished by regulating a distance between a presser rod and a fabric holding plate which is provided to hold the fabric. A means for accomplishing this by regulating a lowest stroke-endpoint of the reciprocating motion of the presser rod is described in another patent application by the same Applicant. In contrast, the present invention is intended to solve the same problem by adjusting the position of the fabric holding plate commensurate with changes of fabric thickness.

SUMMARY OF THE INVENTION

This object of the present invention is accomplished by providing a device comprising a pivotally supported prong or forked rod means where one rod holds the fabric table and another rod is engaged by a reciprocal piston head with a blind stitch sewing needle being adapted to operate in synchronism with said presser rod.

BRIEF DESCRIPTION OF THE DRAWINGS

Referring now to the drawings, which illustrate a preferred embodiment of the present invention.

DETAILED DESCRIPTION OF THE PREFERRED EMBODIMENTS

Figure 1:
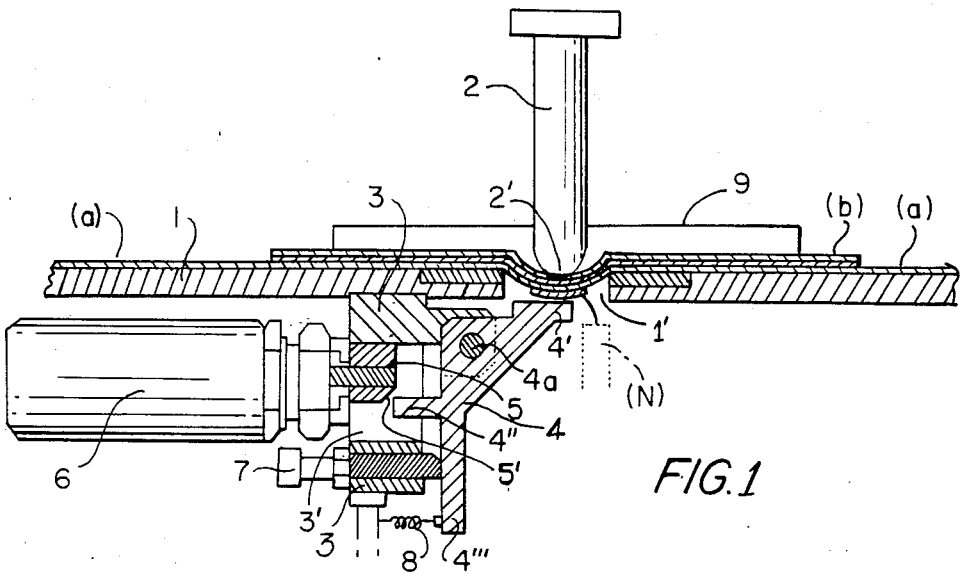
FIG. 1 is a sectional view of a preferred embodiment of the present invention.

There follows a detailed description of preferred embodiments of the invention, wherein like numerals represent like elements throughout the several views.

Referring to the drawings, numeral 1 is an operation table of a sewing machine having a central opening 1'. Numeral 2 is a vertically reciprocating presser rod having a round tip 2' positioned in the opening 1' at about the level of the operation table 1 to press or hold the fabric at its hem in cooperation with a fabric holding plate 4'. A curved blind stitch sewing needle N is provided in close proximity to the plate 4'. Numeral 9 is a presser foot provided to press the fabric in a pile of patch cloth (b) and an underlying fabric (a). The preceding description is similar to that provided in my copending application U.S. Ser. No. 834,541, filed on even date herewith.

The numeral 3 illustrates a support member secured to the bottom surface of the operation table 1. Numeral 4 is a prong or forked rod pivotally supported at 4a such that the first fork rod 4' extends horizontally to provide a fabric holding plate and the second fork rod 4'' extends horizontally, in opposition to rod 4' to contact a piston head 5. Element 4 includes a third rod 4''' extending downwardly for connection with a spring 8 and a screw 7 which are mounted on or through the member 3.

Figure 2:
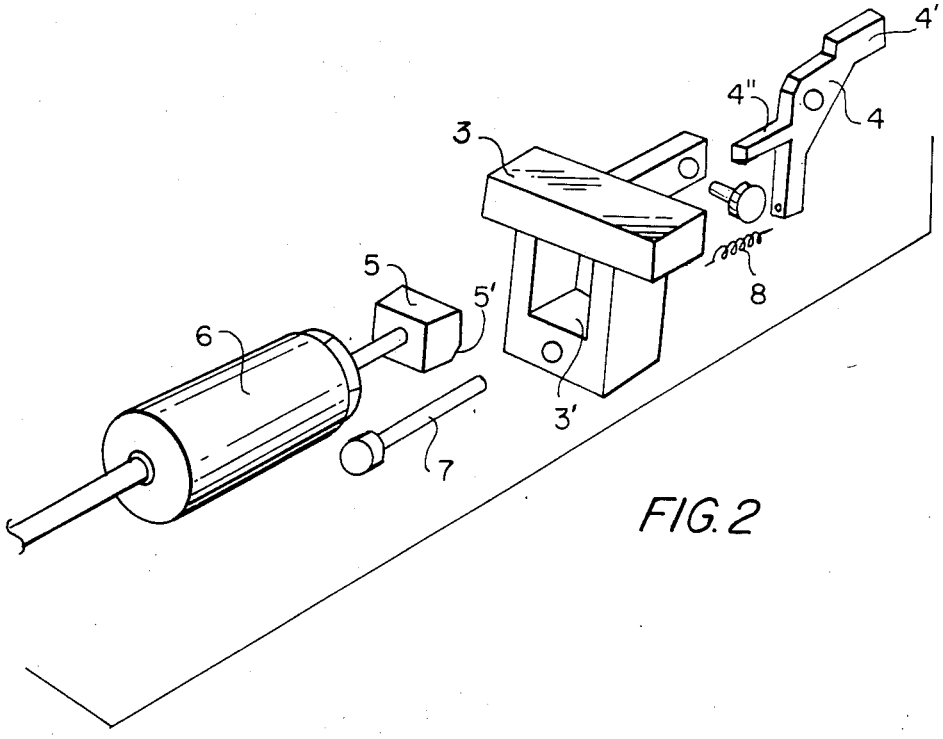
FIG. 2 is an exploded view of the parts shown in FIG. 1.

Numeral 6 is a piston and cylinder unit connected to piston head 5 which is in the form of a square bar, as shown in FIG. 2, which is adapted to fit in a square gate 3' provided in the member 3 (see FIG. 2). The piston head 5 is shaped to move through the square gate 3' of the member 3. The head 5 has a slant undercut 5' on its front which is adapted to contact the rod 4'' within the length of the square gate 3'.

In the operation of the present invention, the presser rod 2 is assumed to operate in continuous short reciprocating strokes in synchronism with the motions of the blind stitch sewing needle N, which needle is independent of changes of fabric thickness. This is explained in greater detail in my copending application Ser. No. 834,549, filed on even date herewith, and entitled DEVICE FOR HOLDING A FABRIC IN PICK-UP SEWING. In the present invention which makes changes in response to changes in fabric thicknesses, the screw 7 is first operated to set the position of the plate 4' at its lowest possible position, allowing for maximum thickness of the fabrics.

Next, the piston head 5 is adjustably moved by some operation signal to make the individual controls commensurate with the thickness of the fabric to be sewn. The contact made by the slant undercut 5' and the rod 4' contributes to dissipate the pressures from the rod 4' into two different directions, sideways and upwards, which operation has the function of absorbing minor vibrations generated by continuous synchronous movements and resisting larger variations or forces than the level of the synchronism.

Although a preferred embodiment of the invention is described herein, it is apparent that numerous modifications and variations are possible, within the spirit and scope of the invention.

I claim:

1. A device for retaining a fabric to be sewn in a blind-stich sewing operation, in combination with an automatic sewing machine, comprising:

means for supporting a fabric to be sewn, a presser rod mounted to press the fabric to be sewn, blind-stich sewing needles positioned to pierce the fabric to sew the same, said presser rod and said blind stitch needles being operable in synchronism with each other, a pivotally supported forked rod having a first rod which defines a fabric table to support the fabric being sewn and a second rod engagable by a piston head, wherein movement of the piston head pivots the forked rod to change the level of the fabric table.

2. A device according to claim 1, wherein the piston head which engages the said other rod has a slant undercut portion.

* * * * *